US005295319A

United States Patent [19]

Jabbar

[11] Patent Number: 5,295,319

[45] Date of Patent: Mar. 22, 1994

[54] EDUCATIONAL CALENDAR UNIT

[75] Inventor: Najat Jabbar, Atherton, Calif.

[73] Assignee: Unlimited International Education, Inc., Menlo Park, Calif.

[21] Appl. No.: 910,946

[22] Filed: Jul. 9, 1992

[51] Int. Cl.[5] ..... G09D 3/00

[52] U.S. Cl. ..... 40/107; 434/304

[58] Field of Search ..... 40/107, 109, 122; 283/2; 434/304

[56] References Cited

U.S. PATENT DOCUMENTS

| | | | |
|---|---|---|---|
| 684,107 | 10/1901 | Rueger | 40/107 |
| 1,343,601 | 7/1920 | White | 40/107 |
| 1,470,065 | 10/1923 | Downer . | |
| 1,636,927 | 7/1927 | Curtis | 40/107 |
| 3,579,882 | 5/1971 | Miyahune | 40/107 |
| 4,142,311 | 3/1979 | Lane | 40/109 |
| 4,176,478 | 12/1979 | Brewer | 40/107 |
| 4,358,906 | 11/1982 | Reininga | 40/107 |
| 4,472,892 | 9/1984 | Yang | 40/107 |
| 4,596,082 | 6/1986 | Lane | 40/107 |
| 4,793,634 | 12/1988 | Alloggiamento | 283/2 |
| 4,934,076 | 6/1990 | Fowler | 40/107 |

OTHER PUBLICATIONS

Catalog of Wholesale Distributing of Tucker, Georgia, for calendar advertisements shown on pp. 148, 149, 210, 221, 222, and unknown page number.

*Primary Examiner*—Peter M. Cuomo
*Assistant Examiner*—Flemming Saether
*Attorney, Agent, or Firm*—Townsend and Townsend Khourie and Crew

[57] ABSTRACT

An improved calendar unit which has removable and shiftable pieces representing the months of the year and the days of the week as well as the weeks of the month. The calendar unit has a panel with portions defining first, second, third and fourth recesses. The first recess receives pieces or bars with the months of the year printed on them. A second recess receives one of the bars depending upon the month of the year in which the calendar unit is being used. In a third recess, pieces having numerals printed on them represent the days of the week and the days of the month. Several pieces are blank on the reverse sides so that they can blank out numerals used during those months having less than thirty-one days. In fourth recesses, members which have artwork printed thereon are inserted on the panel. These members represent the seasons of the year and provide an aesthetic effect for the calendar unit.

19 Claims, 2 Drawing Sheets

EDUCATIONAL CALENDAR UNIT

This invention relates to improvements in educational devices for children and, more particularly, to an improved calendar unit suitable for teaching children how to read a calendar.

BACKGROUND OF THE INVENTION

In teaching a child how to read a calendar, the conventional two-dimensional calendar with printed numbers and words on a sheet is generally used. This technique of learning how to read a calendar is satisfactory but it does not give a young child a hands-on learning experience which is important in rapid learning of subjects that are divided into parts which can be considered physical in nature. Because of this drawback, a need exists for a calendar which can be educational in that a child can assemble the calendar himself or herself. The child can put together the calendar pieces which allows a child to learn the arts of the calendar and thereafter observe at a glance, once the child has learned the technique of reading a calendar, how to determine the month of the year and the date of the month as well as the day of the week. Also, a child achieves greater language skills and mathematic skills by using the calendar. The present invention satisfies the aforesaid need.

SUMMARY OF THE INVENTION

The present invention is directed to an improved calendar unit which has removable and shiftable pieces representing the months of the year and the days of the week as well as the weeks of the month. Thus, a child learning to read a calendar can experience a hands-on manipulation of the pieces which, together with the particular positioning of the pieces, will allow the child to be able to discern the technique of reading a calendar in a minimum of time yet the child can program the calendar unit so as to render it usable for all of the months of the year.

To this end, the calendar unit of the present invention has a panel having cutout portions defining first, second, third and fourth recesses. The first recess is adapted to receive pieces or bars with the months of the year printed on them. A secondary recess on the panel receives one of the bars depending upon the month of the year in which the calendar unit is being used.

In the third recess, pieces having numerals printed on them represent the days of the week and the days of the month. Several of these pieces are blank on the reverse sides so that they can replace pieces having numerals for those months having less than thirty-one days. In a fourth recess, members which have artwork thereon are inserted therein. These latter members represent the seasons of the year and provide an aesthetic effect for the calendar unit. The calendar unit can be mounted in a horizontal position or a vertical position.

The primary object of the present invention is to provide an educational device for children in the form of a calendar unit which has removable pieces which can be placed in strategic locations on or in a panel to represent the particular month of the year of use and the days of the month so that a child using the calendar unit can have hands-on experience and will learn how to use a calendar in a minimum of time yet the calendar is usable throughout an entire year.

Other objects of the present invention will become apparent as the following specification progresses, reference being had to the accompanying drawings for an illustration of the invention.

DETAILED DESCRIPTION OF THE PREFERRED EMBODIMENT

Figure 1:
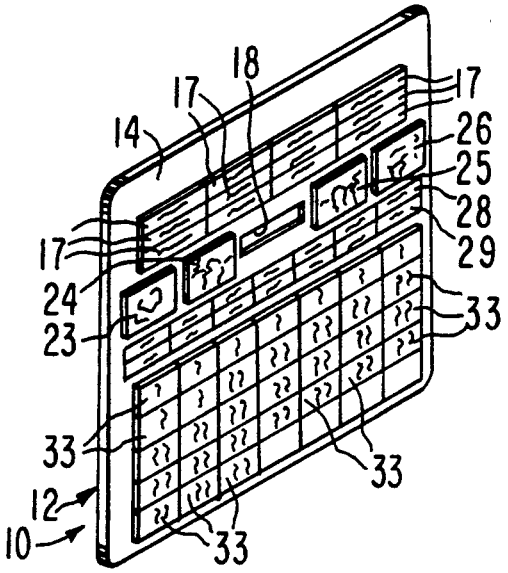
FIG. 1 is a front elevational view of the calendar unit of the present invention, showing the months of the year in one location, the days of the month in another location and a number of artistic scenes representing the seasons of the year.
Figure 2:
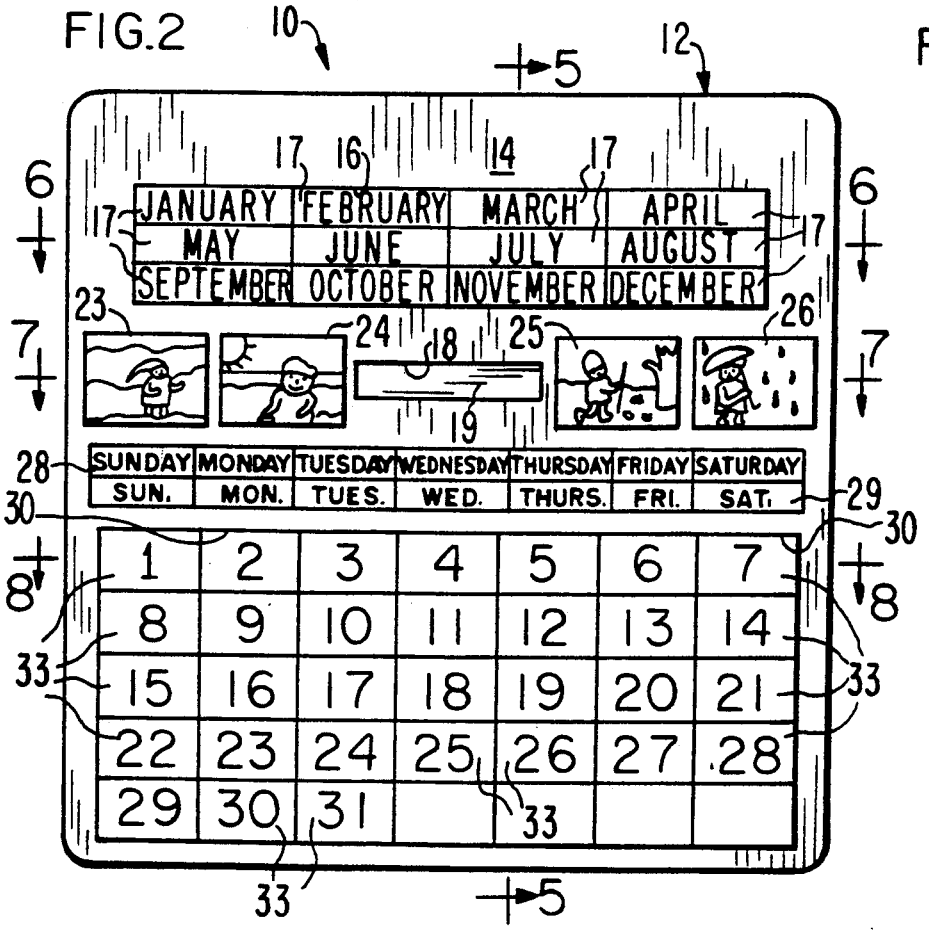
FIG. 2 is a perspective view of the calendar unit.
Figure 3:
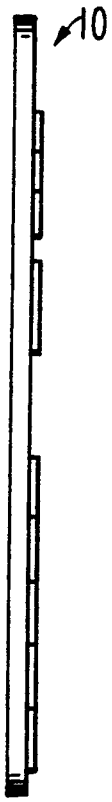
FIG. 3 is an elevational view of one side of the calendar unit
Figure 4:
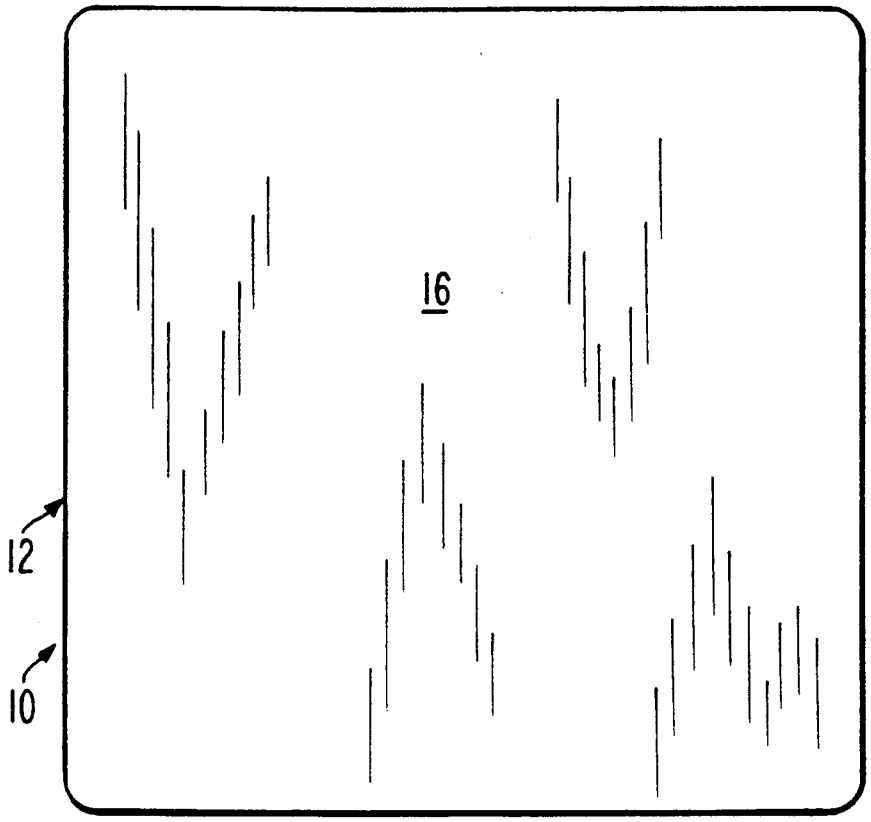
FIG. 4 is a rear elevational view thereof.
Figure 5:
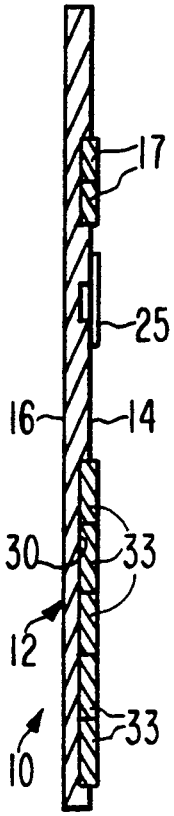
FIG. 5 is a vertical cross sectional view taken along line 5—5 of FIG. 1.
Figure 6:
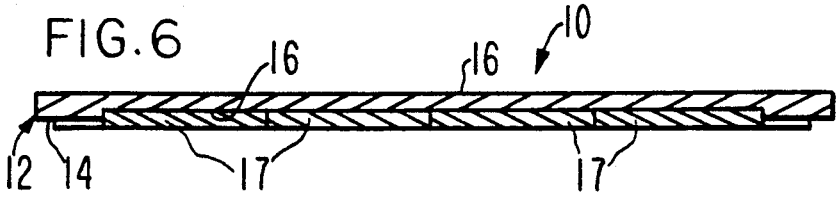
FIGS. 6–8 are cross sectional views taken along lines 6—5, 7—7 and 8—8 of FIG. 1, respectively.
Figure 7:
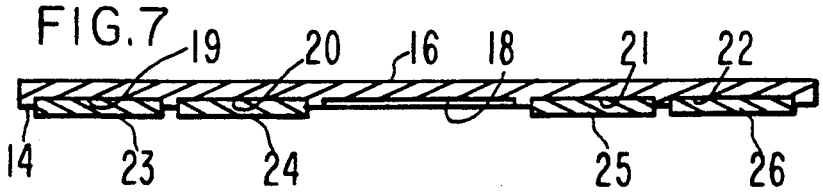
Figure 8:
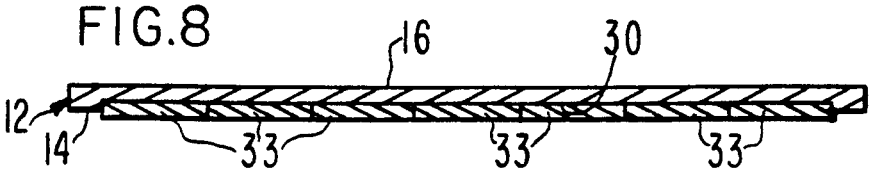

The calendar unit of the present invention is broadly denoted by the numeral 10 and includes a support 12 in the nature of a panel which is generally flat on opposed sides 14 and 16 as shown in FIGS. 2–5. Support 12 can be of any suitable material, such as wood, plastic or the like. It is also capable of being made of plywood or it can be made of two or more panels bonded together to form a composite structure. It can be made of a magnetic material and the calendar can be used by adults as well as children for informational purposes.

Face 14 of support 12 is provided with a first cutout region or recess 16 which is generally rectangular in shape and has a flat inner surface. The cutout recess 16 is routed to a predetermined depth in face 14, such as half the depth. Cutout recess 16 is adapted to removably receive a number of bars 17 which have the month of the year printed thereon. Bars 17 can be of suitable material, such as of the same material as panel or support 12. Bars 17 are essentially of the same size and shape and snugly fill recess 16 in the manner shown in FIGS. 1 and 2.

Panel or support 12 has a flat bottom cutout recess 18 spaced inwardly from cutout region 16, and recess 18 is adapted to receive one of the bars 17 cutout recess 16. Cutout recess 18 is also shown in cross section in FIG. 4. Thus, if the month of the year in question is May, for instance, the bar 17 for May is inserted in recess 18. A blank bar 19 can be used to fill recess 18, if desired.

The panel or support 12 is provided with four flat bottom cutout recesses 19, 20, 21 and 22. These recesses 19-22 are adapted to receive specific insert members 23, 24, 25 and 26 which have artistic renderings on the outer faces thereof, each rendering depicting a specific season of the year, including spring, summer, fall and winter. These can be arranged in any order and they can be viewed from left to right with respect to the sides of the panel or support 12.

The surface portion on face 14 denoted by the numeral 27 and spaced from members 23–26 is provided with printed material in two rows 28 and 29. The printed material sets forth the days of the week. The weekdays in row 28 are printed in full; whereas, the weekdays in row 29 are printed in an abbreviated form.

A cutout recess 30 is provided in the lower part of panel or support 12 and contains thirty-five pieces, each part being denoted by the numeral 33, there being thirty-one pieces provided with numerals from one to thirty-one and four blank pieces without numerals. In the event of the use of calendar unit 10 in months with thirty days, the piece with the numeral "31" can be reversed since its backside is blank. Similarly, for months having twenty-nine or twenty-eight days, the pieces with the numerals "29", "30" and "31" can be reversed since their backsides are blank.

The pieces 33 can snugly fit into flat bottom recess 30 and are removable therefrom since the outer surface of each of the pieces 31 projects above surface 14 of support 12.

In use, a child or other person will first select the particular month of the year and take the bar 17 of that month from recess 16 and place it in recess 18. A blank bar 17 from recess 18 could be used to fill the empty space in recess 16, if desired.

Then, the user will rearrange the positions of pieces 33 so that the first date of the month will fall on a particular day of the week, such as Monday, as shown in FIG. 1. The user must also know the number of days of the month so as to determine whether or not to use the piece marked "31" or the pieces marked "29", "30", or "33". When the pieces 31 are arranged properly, the calendar is ready for use and the support can be placed upon a horizontal surface, such as a tabletop, or can be mounted in a vertical plane adjacent to a vertical wall. During the use of the calendar, the artistic scenes shown on members 23, 24, 25 and 26 remind the user of the seasons of the year. Thus, members 23–26 provide an aesthetic effect for the user when viewing the calendar unit 10.

At the beginning of the next month of use, bar 17 in recess 18 will be replaced by the next month's bar 17 and the pieces 31 will be rearranged depending upon the first day of the month and the total number of days of the month. The calendar unit 10, therefore, provides a simple way to learn quickly the elements of calendar formation.

I claim:

1. A calendar unit comprising:

a support panel having a pair of opposed flat faces, one of the faces having recess means defining a first recess and means defining a second recess, each of the first and second recesses having an innermost boundary, the innermost boundary of each of the recesses being substantially flat;

a plurality of bars for placement in the first recess, each bar having a particular month of the year affixed thereon;

a plurality of individual pieces for insertion in the second recess, each of certain of the pieces being affixed with a number representing a particular day of the month, the pieces being arranged in a number of rows and a group of columns;

means on the panel face for defining the names of the days of the week; and a third recess on the same face as the first and second recess for receiving one of the bars of the first recess, said third recess being above the second recess.

2. A calendar as set forth in claim 1, wherein said means defining the names of the days of the week includes printed indicia.

3. A calendar as set forth in claim 1, wherein there are thirty-five individual pieces.

4. A calendar as set forth in claim 1, wherein the panel has an upper edge and a lower edge, said first recess being adjacent to one of the edges.

5. A calendar unit as set forth in claim 1, wherein a number of said pieces have blank backsides.

6. A calendar unit comprising:

a support panel having a pair of opposed flat faces, one of the faces having means defining a first recess and means defining a second recess, the innermost boundary of each of the first and second recesses being substantially flat;

a plurality of bars for placement in the first recess, each bar having a particular month of the year affixed thereon;

a plurality of individual pieces removably and snugly insertable in the second recess, each of certain of the pieces being affixed with a number representing a particular day of the month, the pieces being arranged in a number of rows and a group of columns;

means on the panel face for defining the names of the days of the week; and a third recess on the same face as the first and second recess for receiving one of the bars the first recess, said third recess being above the second recess.

7. A calendar as set forth in claim 6, wherein there are thirty-five individual pieces.

8. A calendar as set forth in claim 6, wherein the panel has an upper edge and a lower edge, said first recess being adjacent to one of the edges.

9. A calendar unit as set forth in claim 6, wherein a number of said pieces have blank backsides.

10. A calendar as set forth in claim 6, wherein said means defining the names of the days of the week include printed indicia.

11. A calendar unit comprising:

a support panel having a pair of opposed flat faces, one of the faces having recess means defining a first recess and means defining a second recess, each of the first and second recesses having an innermost boundary, the innermost boundary of each of the recesses being substantially flat;

a plurality of bars for placement in the first recess, each bar having a particular month of the year affixed thereon;

a plurality of individual pieces for insertion in the second recess, each of certain of the pieces being affixed with a number representing a particular day of the month, the pieces being arranged in a number of rows and a group of columns; and means on the panel face for defining the names of the days of the week, the bars in the first recess filling the first recess, there being a third recess on the same face as the first and second recess for receiving one of the bars of the first recess.

12. A calendar unit as set forth in claim 11, wherein the third recess is between the first and second recesses.

13. A calendar unit as set forth in claim 11, wherein is included a plurality of fourth recesses, and including a number of insert members received in the fourth recesses for depicting the seasons of the year.

14. A calendar unit as set forth in claim 13, wherein said members are between the first and second recesses.

15. A calendar unit as set forth in claim 13, wherein the third recess being between the first and second recesses, the fourth recess being on opposite sides of the third recess.

16. A calendar unit comprising:

a support panel having a pair of opposed flat faces, one of the faces having means defining a first recess and means defining a second recess, each of the first and second recesses having a substantially flat innermost boundary;

a plurality of bars for placement in the first recess, each bar having a particular month of the year affixed thereon;

a plurality of individual pieces for removable insertion in the second recess, each of certain of the pieces being affixed with a number representing a particular day of the month, the pieces being arranged in a number of rows and a group of columns; and means on the panel face for defining the names of the days of the week, the bars in the first recess filling the first recess, there being a third recess on the same face as the first and second recess for receiving one of the bars of the first recess.

17. A calendar unit as set forth in claim 16, wherein the third recess is between the first and second recesses.

18. A calendar unit as set forth in claim 16, wherein is included a number of fourth recesses, and including a number of insert members received in the fourth recesses for depicting the seasons of the year.

19. A calendar unit as set forth in claim 18, wherein said fourth recesses are between the first and second recesses.

* * * * *